United States Patent [19]

Tsukada

[11] Patent Number: 5,013,637

[45] Date of Patent: May 7, 1991

[54] SILVER HALIDE PHOTOGRAPHIC LIGHT-SENSITIVE MATERIAL

[75] Inventor: Kazuya Tsukada, Hino, Japan

[73] Assignee: Konica Corporation, Tokyo, Japan

[21] Appl. No.: 596,776

[22] Filed: Oct. 11, 1990

[30] Foreign Application Priority Data

Oct. 18, 1989 [JP] Japan ..... 1-270813

[51] Int. Cl.[5] ..... G03C 1/85

[52] U.S. Cl. ..... 430/527; 430/523; 430/621

[58] Field of Search ..... 430/523, 527, 621

[56] References Cited

U.S. PATENT DOCUMENTS

| | | | |
|---|---|---|---|
| 4,022,622 | 5/1977 | Timmerman et al. | 430/527 |
| 4,237,194 | 12/1980 | Upson et al. | 430/527 |
| 4,294,739 | 10/1981 | Upson et al. | 430/527 |
| 4,301,240 | 11/1981 | Bruck et al. . | |

*Primary Examiner*—Jack P. Brammer

*Attorney, Agent, or Firm*—Jordan B. Bierman

[57] ABSTRACT

A silver halide photographic light-sensitive material is disclosed which is improved in antistatic property. The photographic material comprises a support, a silver halide emulsion layer and an antistatic layer comprising a water-soluble conductive polymer, a hydrophobic polymer particle and a silane coupling agent represented by the following Formula I:

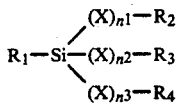

(I)

wherein X is an oxygen atom or a —OCO— group; $R_1$, $R_2$, $R_3$ and $R_4$ are each an alkyl group or an aryl group which may be the same or different and are allowed to be substituted, and at least one of the groups represented by $R_1$, $R_2$, $R_3$ and $R_4$ is a group containing a double bond, a halogen atom, an epoxy group, an acid anhydride residue, an alkoxy group, an alkoxycarbonyl group, an amino group, an acryloyl group, a methacryloyl group, an acrylamido group, a methacrylamido group or a haloacylamino group; $n^1$, $n^2$ and $n^3$ are each 0 or 1, which may be the same or different, provided that the total of $n^1$, $n^2$ and $n^3$ is 1 or more.

14 Claims, No Drawings

SILVER HALIDE PHOTOGRAPHIC LIGHT-SENSITIVE MATERIAL

FIELD OF THE INVENTION

The present invention relates to a silver halide photographic light-sensitive material having an antistatic property, more particularly to a silver halide photographic light-sensitive material having a good antistatic property imparted by an enhanced conductivity of an antistatic layer comprising a water soluble organic conductive polymer, a hydrophobic polymer and a silane coupling agent.

BACKGROUND OF THE INVENTION

Generally, a silver halide photographic light-sensitive material comprises an electrical insulating support and photographic component layers; therefore, it is liable to charge with electricity when rubbed with or peeled from the surface of the same or different kinds of material during a manufacturing process or while put in use. If a static charge accumulated before development is discharged and thereby a light-sensitive layer is exposed, so-called static marks such as dot spots or dendritic or plumous markings appear upon development of an affected photographic film. This seriously impairs the value of the photographic film. For example, a static mark that occurred on an X-ray film for medical or industrial uses is likely to lead to a very dangerous misjudgement. Since such an affection can be found only when the film is developed, it poses a difficult problem. The static mark has come to occur more frequently in the recent trends of a light-sensitive material toward a much higher sensitivity, coating speed, photographing speed and automatic processing speed. That is, contact-rubbing occurs frequently between a high-sensitive material and various rollers or machines, or between light-sensitive materials themselves, in the manufacturing processes such as coating, drying and packaging; moreover, in the steps of film loading, photographing, and automatic development processing.

There have been proposed a variety of methods to improve surface conductivity of the support and coating layer of a light-sensitive material, and the use of various hygroscopic materials, water soluble inorganic salts, and some surfactants and polymers has been attempted.

However, not a few conventional antistatic agents are liable to decrease in effect or adversely affect photographic characteristics depending on the kind of a support or a photographic composition. In some cases, the antistatic property is entirely lost in the course of development.

Taking notice of these conditions, attempts were made to enhance conductivity of a light-sensitive material for the purpose of imparting antistatic property as described in, for example, Japanese Patent Publication Open to Public Inspection (hereinafter referred to as Japanese Patent O.P.I. Publication) No. 84658/1980. This technique could impart some antistatic property, but it turned out to cause peeling of a wet emulsion layer from a support while a light-sensitive material is subjected to development, which may lead to a serious accident.

As speedup in conveying and processing a film has come to the main trend of the industry, stability of an emulsion layer during photographic processes is getting more and more important, and improvement in adhesion of a wet emulsion layer, not to mention dry adhesion, is strongly desired.

SUMMARY OF THE INVENTION

The primary object of the present invention is to provide a silver halide photographic light-sensitive material noticeably improved in antistatic property without a harmful influence upon photographic properties.

The secondary object of the present invention is to provide an antistatic silver halide photographic light-sensitive material less deteriorated in wet film adhesion in a rapid processing.

The tertiary object of the present invention is to provide a silver halide photographic light-sensitive material which does not deteriorate in antistatic property even after a developing process. Other objects of the invention will be clarified by the details below.

These objects of the invention can be attained by silver halide photographic light-sensitive material comprising a support, a silver halide emulsion layer and an antistatic layer comprising a water-soluble conductive polymer, a hydrophobic polymer particle and a silane coupling agent represented by the following Formula I:

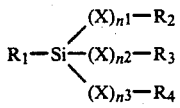

(I)

wherein X is an oxygen atom or a —OCO— group; $R_1$, $R_2$, $R_3$ and $R_4$ are each an alkyl group or an aryl group which may be the same or different and are allowed to be substitued, and at least one of the groups represented by $R_1$, $R_2$, $R_3$ and $R_4$ is a group containing double bond, a halogen atom, an epoxy group, an acid anhydride residue, an alkoxy group, an alkoxycarbonyl group, an amino group, an acryloyl group, a methacryloyl group, an acrylamido group, a methacrylamido group or a haloacrylamino group; $n^1$, $n^2$ and $n^3$ are each 0 or 1, which may be the same or different, provided that the total of $n^1$, $n^2$ and $n^3$ is 1 or more.

DETAILED DESCRIPTION OF THE INVENTION

Some proposals has been made to improve the antistatic property by combining various curing agents with a conductive polymer and a hydrophobic polymer with the same object as in the present invention, and examples of such proposals include Japanese Patent O.P.I. Publication Nos. 44107/1989 and 72916/1989. However, these techniques were still insufficient in preventing perfectly peeling of the coated layer in rapid processing. In such circumstances, it was a surprise to find that the use of a silane coupling agent of the invention noticeably improved dry film adhesion, not to mention wet film adhesion in rapid processing.

Examples of the silane coupling agents represented by Formula I are shown below, but the scope of the invention is not limited to these examples.

| | |
|---|---|
| $ClCH_2CH_2CH_2Si(OCH_3)_3$ | H-1 |
| $H_2NCH_2CH_2CH_2Si(OC_2H_5)_3$ | H-2 |
| $H_2NCH_2CH_2NHCH_2CH_2CH_2Si(OCH_3)_3$ | H-3 |
| $HSCH_2CH_2CH_2Si(OCH_3)_3$ | H-4 |

-continued

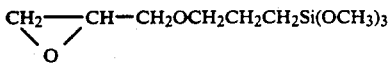

H-5

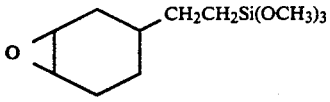

H-6

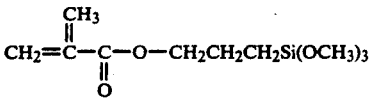

H-7

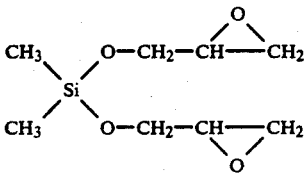

H-8

$CH_2{=}CH{-}Si(OCH_3)_3$ H-9

$CH_2{=}CH{-}Si(OC_2H_5)_3$ H-10

$CH_2{=}CH{-}Si(OCH_2CH_2OCH_3)_3$ H-11

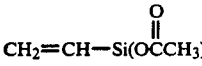

H-12

H-13

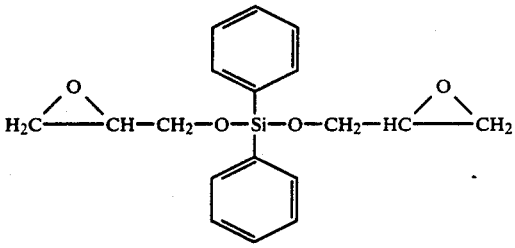

The above compounds are known as a compound to improve adhesion of a coated layer to a glass photographic plate and marketed as a silane coupling agent by Chisso Corp., Toshiba Silicone Ltd., Toray Ind., etc.

In the invention, the foregoing objects can be attained by the use of the above silane coupling agent in an amount of $7.0\times10^{-4}$ to $3.0\times10^{-3}$ mol/dm$^2$.

Next, the water soluble conductive polymer of the invention is described below.

The water soluble conductive polymer of the invention, though capable of forming a transparent layer when used singly, is liable to cause cracks in the layer by a slight deviation of drying condition. In the constitution according to the invention , a hydrophobic polymer is contained to prevent such cracks and works very well.

A water-soluble conductive polymer preferably used in the antistatic layer of the invention is a polymer comprising having a structural unit having an aromatic ring or a heterocyclic ring each of which has a sulfonic acid group or a salt thereof linked directly or via a divalent conjunction group, and has a molecular weight of 100 to 10,000,000, preferably 10,000 to 500,000. Such a polymer can be readily synthesized by polymerizing monomers available in the market or prepared by a conventional method.

Conductivity of the conductive polymer of the invention is characterized by that when the polymer is singly coated on a polyethylene terephthalate film to 2 g/m$^2$ or more, the specific resistance at the surface becomes $10^{10}\Omega$/cm or less at 23° C. and 20% RH.

The examples of the water soluble conductive polymer used in the invention are shown below, but not limited to them.

Homopolymer P-1

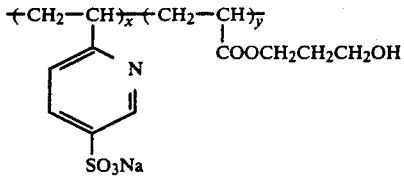

x:y = 70:30

$\overline{M} \approx 20{,}000$

Homopolymer P-2

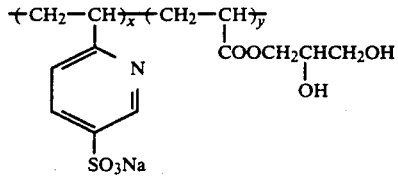

x:y = 70:30

$\overline{M} \approx 700{,}000$

P-3

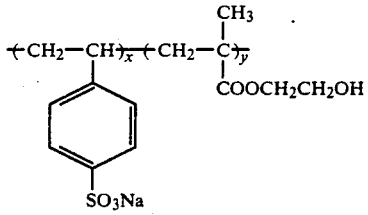

x:y = 70:30

$\overline{M} \approx 10{,}000$

P-4

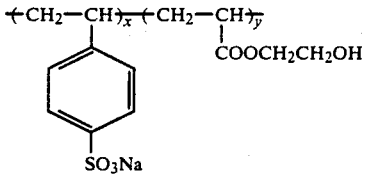

x:y = 70:30

$\overline{M} \approx 5000$

P-5

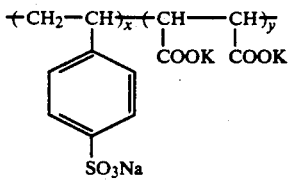

x:y = 50:50

$\overline{M} \approx 6000$

P-6

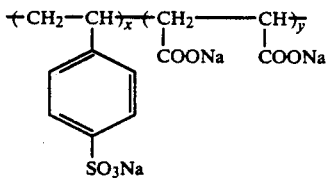

x:y = 65:35

$\overline{M} \approx 120{,}000$

-continued

P-7

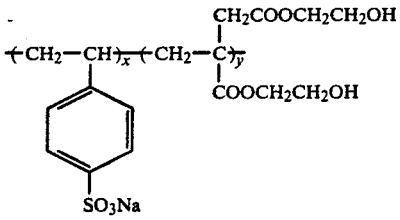

x:y = 98:2

$\overline{M} \approx 200{,}000$

P-8

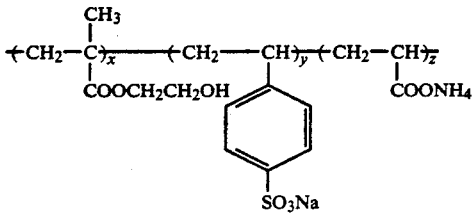

x:y:z = 40:30:1

$\overline{M} \approx 750{,}000$

P-9

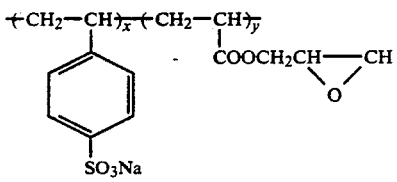

x:y = 70:30

$\overline{M} \approx 20{,}000$

P-10

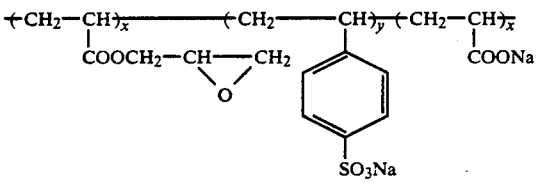

x:y:z = 85:13:2

$\overline{M} \approx 800{,}000$

P-11

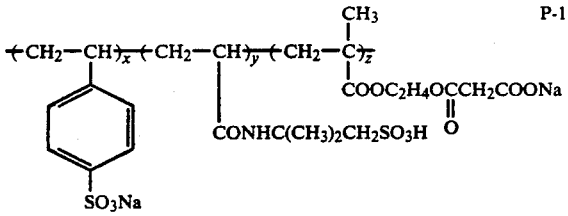

x:y:z = 88:19:3

$\overline{M} \approx 900{,}000$

P-12

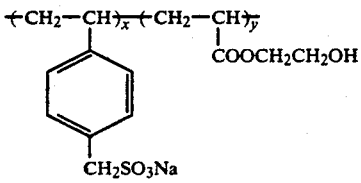

x:y = 80:20

$\overline{M} \approx 1{,}000{,}000$

-continued

P-13

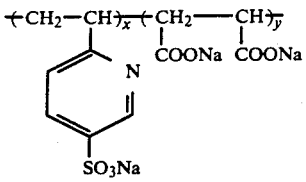

$\overline{M} \approx 10{,}000$ x:y = 80:20

P-14

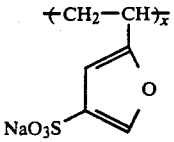

$\overline{M} \approx 200{,}000$

P-15

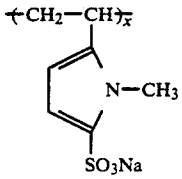

$\overline{M} \approx 200{,}000$

P-16

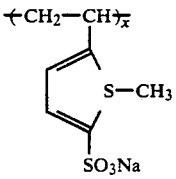

$\overline{M} \approx 150{,}000$

P-17

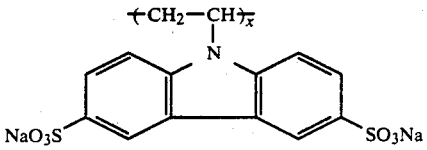

$\overline{M} \approx 300{,}000$

P-18

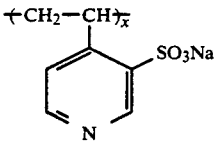

$\overline{M} \approx 280{,}000$

P-19

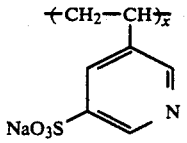

$\overline{M} \approx 450{,}000$

P-20

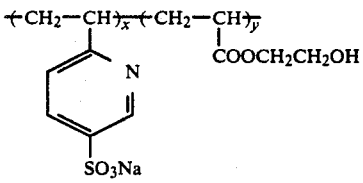

x:y = 60:40

$\overline{M} \approx 800{,}000$

-continued

P-21

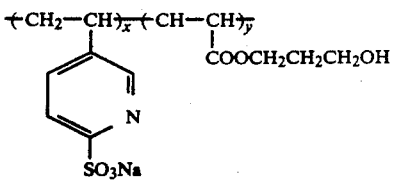

x:y = 70:30

$\overline{M} \approx 650{,}000$

P-22

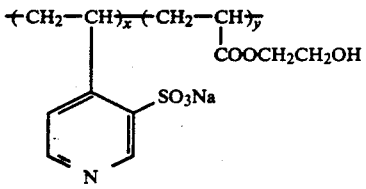

x:y = 80:20

$\overline{M} \approx 500{,}000$

P-23

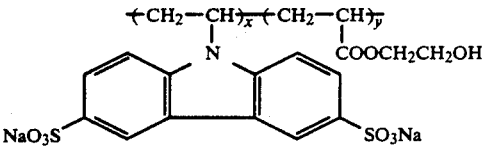

x:y = 75:25

$\overline{M} \approx 400{,}000$

P-24

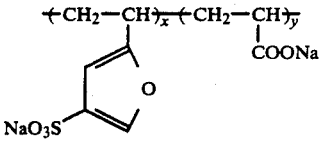

x:y = 80:20

$\overline{M} = 600{,}000$

P-25

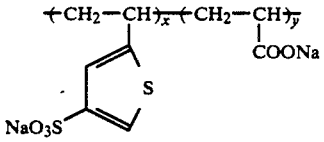

x:y = 90:10

$\overline{M} \approx 400{,}000$

P-26

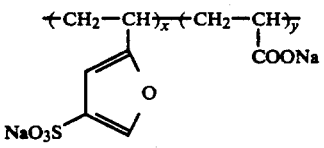

x:y = 55:45

$\overline{M} \approx 320{,}000$

P-27

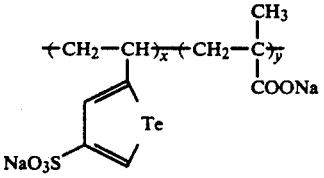

x:y = 90:10

$\overline{M} = 600{,}000$

-continued

P-28

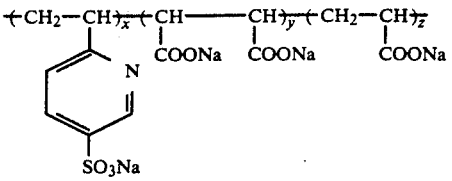

x:y:z = 80:10:10

$\overline{M} \approx 800{,}000$

P-29

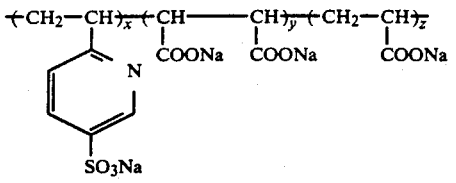

x:y = 70:30

$\overline{M} \approx 10{,}000$

P-30

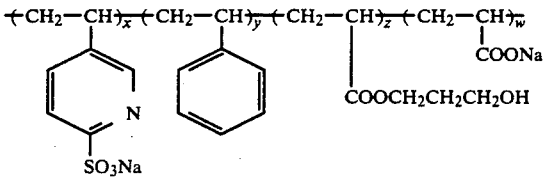

x:y:z:w = 60:30:8:2

$\overline{M} \approx 800{,}000$

P-31

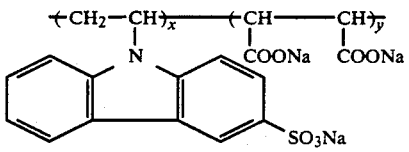

x:y = 60:40

$\overline{M} \approx 30{,}000$

P-32

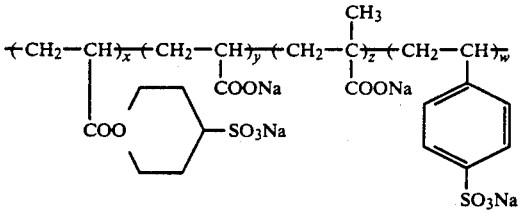

x:y:z:w = 40:30:20:10

$\overline{M} \approx 500{,}000$

P-33

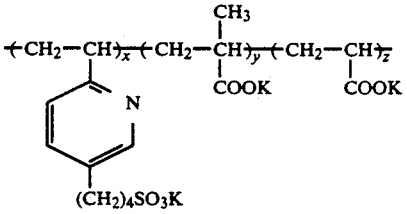

x:y:z = 60:30:10

$\overline{M} \approx 300{,}000$

P-34

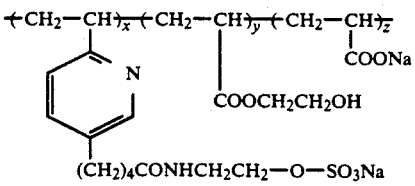

-continued x:y:z = 40:30:30

$\overline{M} \approx 500{,}000$

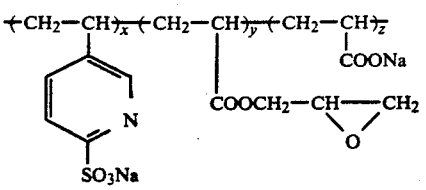

x:y:z = 55:35:10

$\overline{M} \approx 300{,}000$

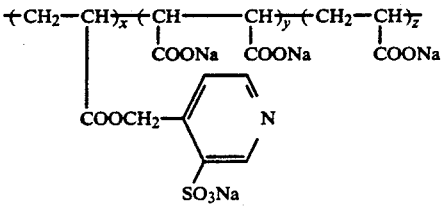

x:y:z = 50:30:20

$\overline{M} \approx 600{,}000$

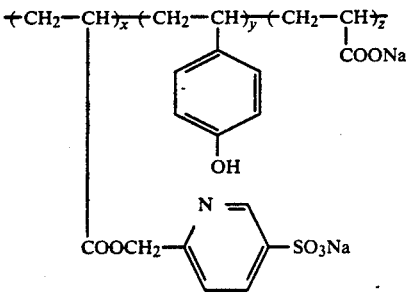

x:y:z = 60:30:10

$\overline{M} \approx 600{,}000$

In the above P-1 to P-37, x, y and z represent mol % of each monomer component; $\overline{M}$ represents an average molecular weight, in this specification, average molecular weight means number average molecular weight.

An amount of the conductive polymer contained in the antistatic layer of the invention is desirably 0.001 to 10 g/m$^2$ in terms of solid polymer, more desirably 0.05 to 5 g/m$^2$.

Next, the hydrophobic polymer particles of the present invention are hereunder described.

The hydrophobic polymer particles are substantially insoluble in water and contained in the form of latex in the antistatic layer of the invention. This hydrophobic polymer can be prepared by polymerization of monomers selected in arbitrary combination from styrene, styrene derivatives, alkyl acrylates, alkyl methacrylates, olefin derivatives, halogenated ethylene derivatives, acrylamide derivatives, methacrylamide derivatives, vinylester derivatives, acrylonitrile, etc. Particularly, a monomer combination containing at least 30 mol % of styrene derivatives, alkyl acrylates or alkyl methacrylates is desirable, more desirable one is a combination containing 50 mol % or more of these monomers.

Two methods are available to prepare a latex of the hydrophobic polymer: one is emulsion polymerization, and the other is a method comprising the steps of dissolving the polymer in a low boiling solvent and atomizing the solution to remove the solvent. Of the two, emulsion polymerization is preferred since it can provide finer and more uniform particles.

Preferable surfactants for emulsion polymerization are of anionic and nonionic types. An addition amount of a surfactant is preferably 10 wt % or less of monomer; an excessive amount is liable to tarnish the conductive layer.

A molecular weight of 3,000 or more is good enough for the hydrophobic polymer, and no difference occurs in transparency with varied molecular weights.

Examples of the hydrophobic polymer of the invention are shown below.

L-1

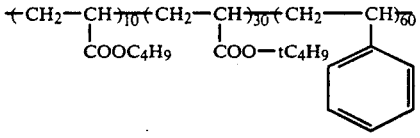

$\overline{M} = 100{,}000$

L-2

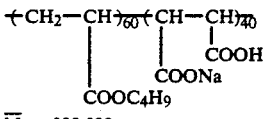

$\overline{M} = 200{,}000$

L-3

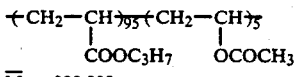

$\overline{M} = 300{,}000$

L-4

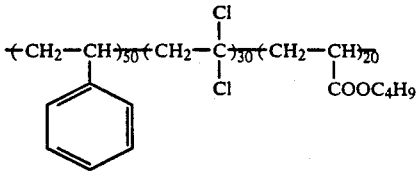

$\overline{M} = 200{,}000$

-continued

L-5

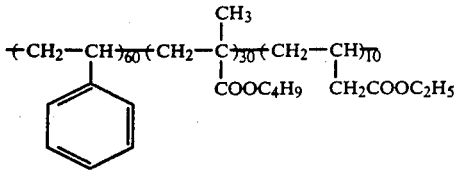

$\overline{M}$ = 300,000

L-6

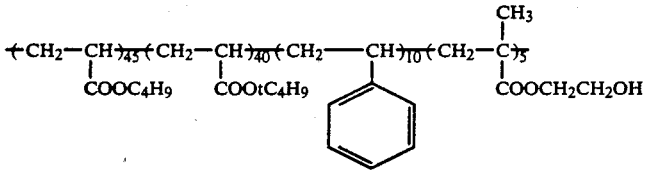

$\overline{M}$ = 500,000

L-7

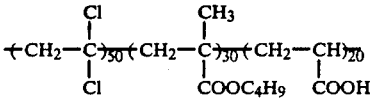

$\overline{M}$ = 200,000

L-8

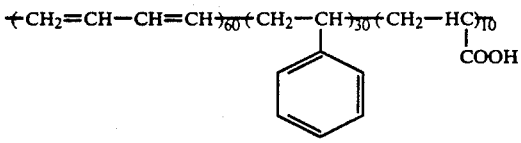

$\overline{M}$ = 600,000

L-9

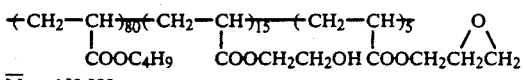

$\overline{M}$ = 150,000

The surface of the antistatic layer is preferably activated by subjecting to corona discharge, glow discharge, or ultraviolet or flame treatment. Of these activation treatments, corona discharge is particularly preferred and favorably carried out density of 1 mw/m$^2$ to 1 kw/m$^2$.min, more favorably 0.1 w/m$^2$ to 1 w/m$^2$.min It is preferable that a bonding layer comprising gelatin or its derivatives is formed on the antistatic layer of the invention when a hydrophilic colloid layer such as an emulsion layer or backing layer is provided on the antistatic conductive layer. This bonding layer may be simultaneously coated together with the conductive layer or coated on the dried conductive layer. The bonding layer is preferably subjected to heat treatment at 70° to 200° C. Various hardeners may be used in the bonding layer, but preferable ones are selected from the hardeners of acrylamide type, aldehyde type, aziridine type, peptide type, epoxy type and vinylsulfone type in view of cross-linking with the lower conductive layer and that with the hydrophilic colloid layer.

A coating solution for the conductive layer containing the organic conductive polymer, hydrophobic polymer particles and silane coupling agent may be coated on a support directly or via a subbed layer. A degree of cross-linking may be pertinently set in order to improve film strength of the antistatic layer. The property of the antistatic layer depends on various conditions such as the mixing ratio of the conductive polymer to the hydrophobic polymer particles, coating and drying conditions of the antistatic layer, the type and amount of a curing agent used; therefore, proper conditions have to be set up for a desired property. A preferable degree of cross-linking in the antistatic layer can be determined based on such conditions.

Moreover, a metal oxide may be added to the antistatic layer to enhance further the effect of the invention.

The metal oxide used in the antistatic layer according to a specific requirement is indium oxide, tin oxide, a metal oxide doped with antimony atoms or phosphorus atoms, or a mixture thereof.

Indium (I) oxide ($In_2O$) and indium (III) oxide ($In_2O_3$) are known as indium oxide. Of them, indium (III) oxide is preferably used in the invention.

Stannous oxide (SnO) and stannic oxide ($SnO_2$) are known as tin oxide, and stannic oxide is preferably used in the invention. Examples of the metal oxide doped with antimony atoms or phosphorus atoms include doped tin oxide and doped indium oxide. Such doped metal oxides can be prepared by mixing a halide, alkoxide or nitrate of tin or indium with a halide, alkoxide or nitrate of antimony or phosphorus, and then calcining the mixture to oxidize. These metallic compounds used for preparation of the oxides are readily available. A content of antimony or phosphorus in the doped metal oxides is preferably 0.5 to 10% by weight of tin or indium.

As a preferable embodiment of the invention, an antistatic layer may be formed on a subbed polyethylene terephthalate support.

Next, there is provided thereon a hydrophilic colloidal layer (the first layer) such as a silver halide photographic emulsion layer, anti-halation layer, intermediate layer or backing layer, preferably a light-sensitive silver halide emulsion layer or backing layer.

On the first layer may be formed a layer such as a protective layer, intermediate layer, silver halide photographic emulsion layer, filter layer, development regulation layer, antistatic layer or ultraviolet absorbing layer (the second layer).

The second layer is preferably a protective layer or silver halide emulsion layer substantially having no light-sensitivity.

The term "a hydrophilic colloidal layer" used herein means a hydrophilic colloidal layer formed in a silver halide photographic light-sensitive material and denotes a layer such as silver halide emulsion layer, protective layer, intermediate layer, antihalation layer, filter layer, development regulation layer, ultraviolet absorbing layer, subbed layer and backing layer, those of which are necessary to a photographic light-sensitive layer and contain a binder component including gelatin.

In the antistatic later according to the invention, it is preferred that the type and mixing ratio of the conductive polymer and hydrophobic polymer particles, and the type, amount of addition and drying conditions of the silane coupling as the agent are set to optimum conditions as mentioned above.

The degree of cross-linking given by a curing agent in the antistatic layer can be measured by a degree of swelling, which is determined by dipping a specimen in pure water for 60 minutes at 25° C., followed by electron microscopic observation of the swollen specimen and a dry specimen using an adapter that facilitates a measurement of film thickness in water. Then, the degree of swelling is calculated by the equation: Degree of swelling=(swollen thickness−dry thickness)/dry thickness. The degree of swelling can be also determined by an indirect method which comprises the steps of measuring a weight of absorbed water from a weight difference between a swollen specimen and a dry one both of which have a fixed dry size, determining an increase in volume from the weight of water, calculating a film thickness from specific gravity, and determining the degree of swelling. A preferable degree of swelling is 0.2 to 100%, a particularly preferable one is 2 to 50%.

The thickness of the antistatic layer is closely related to conductivity, and a larger conductivity can be obtained by increasing the thickness of the conductive layer, but this is likely to impair flexibility of the film. Consequently, the thickness of the conductive layer is desirably 0.1 to 100 μm, more desirably 0.1 to 10 μm.

An emulsion used in the silver halide photographic light-sensitive material of the invention may use any of silver iodobromide, silver iodochloride and silver iodochlorobromide, but silver iodobromide is preferred in view of high sensitivity.

Silver halide grains in the photographic emulsion may be any of an isotropic grain such as cube, octahedron and tetradecahedron; a polyhedral grain like a sphere; a twinned crystal with plane defects; or a mixture or composite thereof. These silver halide grains may range from fine size below 0.1 μm to large size of 20 μm.

The emulsion used in silver halide photographic light-sensitive material of the invention can be prepared by such conventional methods as described in Emulsion Preparation and Types on pp. 22 to 23 of Research Disclosure (RD) No. 17643 (Dec., 1978) and the article on p. 648 of RD No. 18716 (Nov., 1979); on pp. 38 to 104 of The Theory of the Photographic Process, 4th Edition, by T. H. James, published by Macmillan Ltd.; and in Photographic Emulsion Chemistry, by G. F. Dauffin, published by Focal Press Ltd. (1966), Chimie et Physique Photographique, by P. Glafkides, published by Paul Montel Ltd. (1967) and Making and Coating Photographic Emulsion, by V. L. Zelikman et al., published by Focal Press Ltd. (1964).

In other words, the emulsion can be prepared by means of solvent conditions such as the neutral method, acid method and ammoniacal method; mixing conditions such as the single-jet method, reverse mixing method, double-jet method and controlled double-jet method; grain preparation conditions such as the conversion method and core/shell method; and combinations thereof.

One preferable embodiment of the present invention is a monodispersed emulsion in which silver iodide is localized inside the grain. The term "monodispersed emulsion" used herein means that at least 95% by number or weight of the silver halide grains are in a range of average grain size ±40%, preferably +30%, when the average grain size is measured by a conventional method. Grain size distribution of the silver halide may be either a monodispersed emulsion having a narrow distribution or a multidispersed emulsion having a wide distribution.

In the silver halide grain, composition of silver halide may change from outer portion to inner portion. A preferable emulsion of the invention is a core/shell type monodispersed emulsion of which grains have a clear double-layered structure consisting of the core with a high iodine content and the outer shell with a low iodine content.

In the present invention, a silver iodide content in the core is normally 20 to 40 mol %, preferably 20 to 30 mol %.

Such a monodispersed emulsion can be prepared by conventional methods described in, for example, J. Phot. Sic. 12, pp. 242 to 251 (1963), Japanese Patent O.P.I. Publication Nos. 36890/1973, 16364/1977, 142329/1980, 49938/1983, British Patent No. 1,413,748 and U.S. Pat. Nos. 3,574,628 and 3,655,394.

A preferred monodispersed emulsion is one in which grains are grown from seed grains by feeding silver ions and halide ions thereto. Methods to prepare a core/shell type emulsion are described in details in, for example, British Patent No. 1,027,146, U.S. Pat. Nos. 3,505,068, 4,444,877 and Japanese Patent O.P.I. Publication No. 14331/1985.

The silver halide emulsion used in the invention may comprised of tabular grains having an aspect ratio of 5 or more.

Such tabular grains have advantages in a high efficiency of spectral sensitization and an improved graininess and sharpness of images, and can be prepared by methods described in British Patent No. 2,112,157, U.S. Pat. Nos. 4,439,520, 4,433,048, 4,414,310, 4,434,226.

The above emulsion may be either a surface latent image type which forms latent images on the grain surface or an internal latent image type which forms latent images inside the grain. In these emulsions, may be used a cadmium salt, lead salt, zinc salt, thallium salt, iridium salt or its complex, rhodium salt or its complex, or iron salt or its complex, in the stages of physical ripening or grain preparation. The emulsion may be subjected to desalination treatment by noodle washing method, flocculation method or ultrafiltration method for removing soluble salts. Preferred desalination methods are one which uses an aromatic hydrocarbon aldehyde resin containing sulfo groups described in Japanese Patent Examined Publication No. 16086/1960 and a method which uses polymer flocculants G 3 and G 8 exemplified in Japanese Patent O.P.I. Publication No. 158644/1988.

The emulsion of the invention may use various additives in the processes before or after physical ripening or chemical ripening. Conventional additives can be seen in, for example, Research Disclosure Nos. 17643 (December, 1978) and 18716 (November, 1979). Types and locations cited of these additives in the Research Disclosures are as follows:

| | RD-17643 | | RD-18716 | |
|---|---|---|---|---|
| Additives | Page | Class. | Page | Class. |
| Chemical sensitizers | 23 | III | 648 | upper right |
| Sensitizing dyes | 23 | IV | 648<br>649 | right to<br>left |
| Developing accelerators | 29 | X X I | 648 | upper right |
| Antifogging agents | 24 | VI | 649 | lower right |
| Stabilizers | " | " | | |
| Antistain agents | 25 | VII | 650 | left to right |
| Image stabilizers | 25 | VII | | |
| Ultraviolet absorbents | 25 to 26<br>↓ | VIII<br>↓ | 649<br>650 | right to<br>left |
| Filter dyes | " | " | | |
| Whitening agents | 24 | V | | |
| Hardener | 26 | X | 651 | left |
| Coating aids | 26 to 27 | XI | 650 | right |
| Surfactants | 26 to 27 | XI | 650 | right |
| Plasticizers | 27 | XII | " | |
| Lubricants | " | | | |
| Antistatic agents | 27 | XII | " | |
| Matting agents | 28 | X VI | 650 | right |
| Binders | 26 | IX | 651 | left |

Examples of the support usable in the light-sensitive material of the invention include ones described on page 28 of the foregoing RD-17643 and page 647 of RD-18716.

Preferable supports are plastic films and the likes. The surface of a support may be coated with a subbed layer or subjected to corona discharge or ultraviolet radiation to enhance adhesion to the coating layer, and the coating emulsion of the invention may be applied to one side or both sides of such a surface-treated support.

The present invention is applicable to every silver halide photographic light-sensitive material, and particularly suitable to a high speed monochromatic light-sensitive material.

In the medical X-ray radiography, a fluorescence intensifying screen containing a phosphor is used, which emits near ultraviolet rays or visible rays when exposed to penetrating radiation. In applying the present invention to this X-ray radiography, it is preferred that the intensifying screen be attached to both sides of a light-sensitive material coated on both sides with the emulsion of the invention and then exposed.

The term "penetrating radiation" used herein means high energy electromagnetic waves such as X-rays and γ-rays.

The fluorescence intensifying screen is an intensifying screen containing calcium tungstate as a primary fluorescent component or one containing a rare earth compound activated with terbium as a primary component.

EXAMPLES

EXAMPLE 1

A monodispersed cubic grain silver iodobromide emulsion having an average grain size of 0.3 μm and containing 2 mol % of silver iodide was prepared by the double-jet method under reaction conditions of 60° C., pAg 8 and pH 2. An electron microscopic observation proved that the content of twinned crystals was not more than 1% by number.

Using this emulsion as a seed emulsion, silver halide grains were grown further as described below.

The above seed grains were dissolved in an aqueous gelatin solution at 40° C., and pH was adjusted to 9.5 with aqueous ammonia and acetic acid. After adjusting pAg to 7.3 with an ammoniacal silver nitrate solution, an ammoniacal silver nitrate solution and a solution containing potassium iodide and potassium bromide were added thereto by the double-jet method to form silver iodobromide layer containing 30 mol % of silver iodide on the seed grain, while keeping pH and pAg constant. After adjusting pH and pAg to 9 and 9.0 respectively with acetic acid and silver bromide, the ammoniacal silver nitrate solution and potassium bromide solution were simultaneously added to grow the grains to 90% of the prescribed grain size. During this process, pH was gradually lowered from 9.0 to 8.20.

Then, pAg was adjusted to 11 by adding a potassium bromide solution, and the ammoniacal silver nitrate solution and potassium bromide solution were added to grow the grains, while reducing pH gradually to 8. Thus, a silver iodobromide emulsion having an average grain size of 0.7 μm and a silver iodide content of 2 mol % was prepared.

While keeping the emulsion at 40° C., a proper amount of sodium naphthalenesulfonate formaldehyde resin, average degree of polymerization: 4 to 6, was added thereto to flocculate silver halide grains. After decantation, a pure water of 40° C. was added, then silver halide grains were flocculated again by the addition of magnesium sulfate, and decantation followed. This procedure was repeated again, and then gelatin was added to obtain an emulsion having a pH of 6.0 and a pAg of 8.5.

The emulsion was chemically ripened by adding ammonium aurothiocyanate and sodium thiosulfate under conditions to impart the highest sensitivity.

Next, a proper amount of 4-hydroxy-6-methyl-1-3,3a,7-tetrazaindene was added to the emulsion as stabilizer.

Further, 300 mg per mol silver of the following sensitizing dye (A) and 15 mg per mol silver of the sensitizing dye (B) were added in the course of chemical ripening.

Spectral sensitizing dye (A)

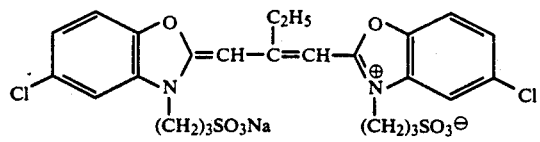

-continued

Spectral sensitizing dye (B)

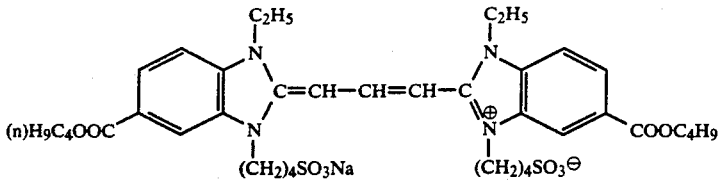

The following additives were used to prepare coating solutions for the silver halide emulsion layer. Addition amounts are per mol silver halide.

| | |
|---|---|
| 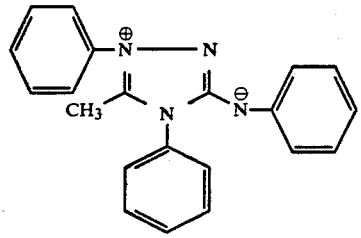 | 150 mg |
| t-butyl catechol | 400 mg |
| Polyvinylpyrrolidone (molecular weight: 10,000) | 1.0 g |
| Styrene-maleic anhydride copolymer | 2.5 g |
| Trimethylolpropane | 10 g |
| Diethylene glycol | 5 g |
| Nitrophenyl-triphenyl phosphonium chloride | 50 mg |
| Ammonium 1,3-dihydroxybenzene-4-sulfonate | 4 g |
| Sodium 2-mercaptobenzimidazole-5-sulfonate | 1.5 mg |
| 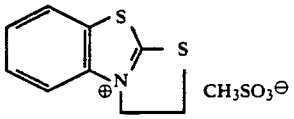 | 70 mg |
| 1-phenyl-5-mercaptotetrazole | 1 mg |
| $n\text{-}C_4H_9OCH_2CH(OH)CH_2N(CH_2COOH)_2$ | 1 g |

The following additives were used to prepare coating solutions for the protective layer. Addition amounts are per gram of gelatin.

| | |
|---|---|
| Matting agent (silicon dioxide powder and polymethylmethacrylate having an area average particle size of 7 μm) | 7 mg |
| Colloidal silica (average particle size: 0.013 μm) | 70 mg |
| Sodium 2,4-dichloro-6-hydroxy-1,3,5-triazine | 30 mg |
| $(CH_2{=}CHSO_2{-}CH_2)_2O$ | 36 mg |
| 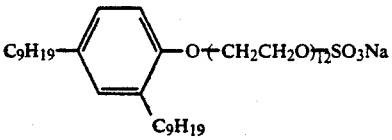 | 12 mg |

-continued

| | |
|---|---|
| 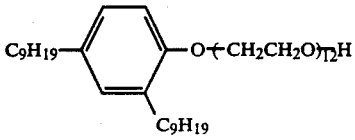 | 2 mg |
| $CH_2COO(CH_2)_9CH_3$ / $CHCOO(CH_2)_2CH(CH_3)_2$ / $SO_3Na$ | 7 mg |
| 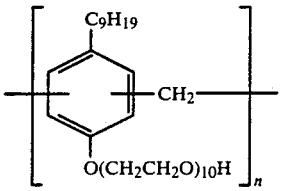 (a mixture of 2 to 5 of n) | 15 mg |
| $NaO_3S{-}CH(CH_2COOCH_2(C_2F_4)_3H){-}COOCH_2(C_2F_4)_3H$ | 5 mg |
| $F_{19}C_9{-}O(CH_2CH_2O)_{10}CH_2CH_2{-}OH$ | 3 mg |

As the support according to the invention, the following base film was prepared and used.

A subbed blue-colored polyethylene terephthalate base with a thickness of 180 μm was subjected to corona discharge at an energy density of 8 $w/m^2 \cdot min$. Then, a coating solution for the antistatic layer having the following composition was coated on both side of the base film at a speed of 30 m/min with a roll fit coating pan and an air knife. The coating amount of the solution was controlled as shown in Table 1.

| (Composition of the antistatic layer) | |
|---|---|
| Water soluble conductive polymer | shown in Table 1 |
| Hydrophobic polymer particles | shown in Table 1 |
| Hardening agent | shown in Table 1 |

Next, these antistatic layers were subjected to the above corona discharge for surface activation.

Then, the above coating solutions for the emulsion layer and for the protective layer were coated in this order over the conductive layers on both sides of the support to prepare Samples 1 to 18. The total coating weight on both sides was adjusted to 6.2 $g/m^2$ of gelatin and 4.6 $g/m^2$ of silver for all the samples.

The samples prepared as above were evaluated for the adhesion of the coated layer.

(1) Adhesion test (Adhesion test on dry layer)

Shallow grid-form incisions were made on the emulsion layer of a sample with a razor; a pressure sensitive adhesive tape was fastened thereon, and then quickly peeled off. A ratio of the emulsion layer left on the tape to the total fastened area was shown in percentage. (Adhesion test in processing layer)

Grid-form scratches were made on the emulsion layer with a sharp tip like awl in a processing bath; the scratched surface was rubbed, and a remaining ratio of the emulsion layer was shown in percentage. A value more than 80% means that the sample can be put in practical use without trouble. The results are shown in Table 1.

TABLE 1

| Sample No. | Conductive polymer Example Comp. | g/m² | Hydrophobic polymer Example Comp. | g/m² | Hardening agent Example Comp. | mol/dm² | Dry layer adhesion (%) | Layer adhesion in processing (%) | Remarks |
|---|---|---|---|---|---|---|---|---|---|
| 1 | P-1 | 0.6 | L-1 | 0.4 | H-1 | $2.0 \times 10^{-3}$ | 80 | 90 | Invention |
| 2 | P-1 | 0.6 | L-1 | 0.4 | H-1 | $1.0 \times 10^{-3}$ | 85 | 90 | Invention |
| 3 | P-1 | 0.6 | L-1 | 0.4 | H-1 | $2.5 \times 10^{-3}$ | 95 | 90 | Invention |
| 4 | P-3 | 0.6 | L-1 | 0.4 | H-3 | $2.5 \times 10^{-3}$ | 95 | 90 | Invention |
| 5 | P-3 | 0.6 | L-4 | 0.4 | H-3 | $2.5 \times 10^{-3}$ | 95 | 95 | Invention |
| 6 | P-3 | 0.6 | L-4 | 0.4 | H-3 | $2.5 \times 10^{-3}$ | 95 | 95 | Invention |
| 7 | P-5 | 0.6 | L-4 | 0.4 | H-5 | $2.5 \times 10^{-3}$ | 95 | 90 | Invention |
| 8 | P-5 | 0.6 | L-4 | 0.4 | A* | $2.5 \times 10^{-3}$ | 70 | 60 | Comparison |
| 9 | P-5 | 0.6 | L-6 | 0.4 | H-5 | $1.0 \times 10^{-3}$ | 90 | 85 | Invention |
| 10 | P-5 | 0.6 | L-6 | 0.4 | H-8 | $1.0 \times 10^{-3}$ | 85 | 85 | Invention |
| 11 | P-9 | 0.6 | L-6 | 0.4 | H-8 | $1.0 \times 10^{-3}$ | 85 | 90 | Invention |
| 12 | P-9 | 0.6 | L-1 | 0.4 | B* | $1.0 \times 10^{-3}$ | 65 | 50 | Comparison |
| 13 | P-9 | 0.6 | L-4 | 0.4 | H-8 | $1.0 \times 10^{-3}$ | 95 | 90 | Invention |
| 14 | P-13 | 0.6 | L-4 | 0.4 | H-8 | $2.0 \times 10^{-3}$ | 70 | 55 | Invention |
| 15 | P-13 | 0.6 | L-4 | 0.4 | C* | $2.0 \times 10^{-3}$ | 65 | 55 | Comparison |
| 16 | P-13 | 0.6 | L-6 | 0.4 | — | — | 60 | 50 | Comparison |
| 17 | P-13 | 0.6 | — | — | — | — | 60 | 50 | Comparison |
| 18 | — | — | L-1 | 0.4 | — | — | 60 | 50 | Comparison |

Notes: Comparative curing agent

A
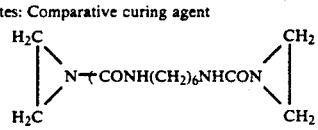

B
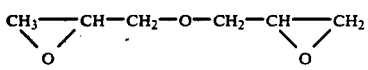

C
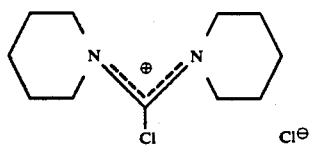

As seen in Table 1, samples of the invention are excellent in adhesion of the coated layer; particularly, use of the curing agents of the invention improves the adhesion during development processing.

EXAMPLE 2

Using the emulsions prepared in Example 1, an antistatic layer, emulsion layer and protective layer were respectively coated on the both sides in the same manner provided with a gelatin layer was provided between the antistatic layer and the emulsion layer. Composition of each sample were as shown in Table 2.

The samples prepared as above were divided into three groups of the equal numbers. The first group included fresh samples for immediate evaluation, the second group was preserved for 3 days at 23° C., 55% RH (preservation I), and the third group was first conditioned for 3 hours at 23° C. and 55% RH, then piled up and put into a moisture-proof bag to preserve for 3 days at 55° C. for the purpose of forced deterioration (preservation II).

Then, the samples were exposed to a standard light through an optical wedge in 0.1 second without a filter so as to receive the same exposure of 3.2 CMS at the front surface of the wedge on both sides, and then processed in an XD-SR developer at 32° C. for 45 minutes with an automatic processing machine Model SRX-501 (both the developer and machine are made by Konica Corp.) for sensitometry.

The sensitivity is defined by a reciprocal of an exposure necessary to form an image having a density of 1.0 on the fog density. The sensitivities shown in Table 2 are the values relative to that of Sample 19 which is set at 100.

The surface specific resistances were measured by putting a sample between a pair of brazen electrodes (interval: 0.14 cm, length: 10 cm) and subjecting measurement for 1 minute with a resistance meter Model TR 8651 made by Takeda Riken Ltd. Samples included developed ones and non-developed ones, each of which was conditioned at 25° C., 20% RH for 2 hours prior to measurement. The results are shown in Table 2.

TABLE 2

| Sample No. | Conductive polymer Example Comp. | Conductive polymer g/m² | Hydrophobic polymer Example Comp. | Hydrophobic polymer g/m² | Curing agent Example Comp. | Curing agent g/m² | Surface specific resistance (Ω · cm⁻¹) Fresh Before processing | Fresh After processing | Preservation I Before processing | Preservation I After processing | Presentation II Before processing | Presentation II After processing | Sensitivity Fresh | Sensitivity Preservation I | Sensitivity Preservation II | Remarks |
|---|---|---|---|---|---|---|---|---|---|---|---|---|---|---|---|---|
| 19 | P-1 | 0.6 | L-2 | 0.4 | H-4 | $3.0 \times 10^3$ | $1.8 \times 10^{11}$ | $4.0 \times 10^{11}$ | $2.0 \times 10^{11}$ | $4.0 \times 10^{11}$ | $2.5 \times 10^{11}$ | $4.3 \times 10^{11}$ | 100 | 98 | 102 | Invention |
| 20 | P-1 | 0.6 | L-5 | 0.4 | H-4 | $3.0 \times 10^3$ | $1.8 \times 10^{11}$ | $4.0 \times 10^{11}$ | $2.1 \times 10^{11}$ | $4.0 \times 10^{11}$ | $3.5 \times 10^{11}$ | $4.3 \times 10^{11}$ | 101 | 99 | 102 | Invention |
| 21 | P-15 | 0.6 | L-5 | 0.4 | H-4 | $3.0 \times 10^3$ | $1.8 \times 10^{11}$ | $4.0 \times 10^{11}$ | $2.1 \times 10^{11}$ | $4.0 \times 10^{11}$ | $3.5 \times 10^{11}$ | $4.3 \times 10^{11}$ | 102 | 100 | 103 | Invention |
| 22 | P-17 | 0.6 | L-5 | 0.5 | H-7 | $3.0 \times 10^3$ | $1.9 \times 10^{11}$ | $4.0 \times 10^{11}$ | $2.1 \times 10^{11}$ | $4.0 \times 10^{11}$ | $3.6 \times 10^{11}$ | $4.3 \times 10^{11}$ | 100 | 100 | 102 | Invention |
| 23 | P-17 | 0.7 | L-7 | 0.5 | H-7 | $3.0 \times 10^3$ | $1.9 \times 10^{11}$ | $4.0 \times 10^{11}$ | $2.0 \times 10^{11}$ | $4.0 \times 10^{11}$ | $3.6 \times 10^{11}$ | $4.3 \times 10^{11}$ | 101 | 100 | 103 | Invention |
| 24 | P-21 | 0.6 | L-7 | 0.5 | H-7 | $3.0 \times 10^3$ | $1.9 \times 10^{11}$ | $4.2 \times 10^{11}$ | $2.0 \times 10^{11}$ | $4.0 \times 10^{11}$ | $3.6 \times 10^{11}$ | $4.5 \times 10^{11}$ | 100 | 99 | 102 | Invention |
| 25 | P-21 | 0.6 | L-7 | 0.5 | H-12 | $3.0 \times 10^3$ | $1.9 \times 10^{11}$ | $4.2 \times 10^{11}$ | $2.0 \times 10^{11}$ | $4.2 \times 10^{11}$ | $3.6 \times 10^{11}$ | $4.5 \times 10^{11}$ | 102 | 101 | 102 | Invention |
| 26 | P-21 | 0.6 | L-9 | 0.5 | H-12 | $3.0 \times 10^3$ | $1.8 \times 10^{11}$ | $4.2 \times 10^{11}$ | $2.2 \times 10^{11}$ | $4.2 \times 10^{11}$ | $3.5 \times 10^{11}$ | $4.5 \times 10^{11}$ | 103 | 102 | 104 | Invention |
| 27 | P-32 | 1.0 | L-9 | 0.4 | H-12 | $3.0 \times 10^3$ | $1.8 \times 10^{11}$ | $4.2 \times 10^{11}$ | $2.2 \times 10^{11}$ | $4.2 \times 10^{11}$ | $3.5 \times 10^{11}$ | $4.5 \times 10^{11}$ | 104 | 102 | 105 | Invention |
| 28 | P-32 | 0.8 | L-9 | 0.4 | H-9 | $3.0 \times 10^3$ | $1.8 \times 10^{11}$ | $4.2 \times 10^{11}$ | $2.2 \times 10^{11}$ | $4.2 \times 10^{11}$ | $3.5 \times 10^{11}$ | $4.5 \times 10^{11}$ | 100 | 99 | 102 | Invention |
| 29 | — | — | — | — | — | — | $3.5 \times 10^{11}$ | $4.5 \times 10^{11}$ | $3.3 \times 10^{11}$ | $8.2 \times 10^{11}$ | $6.2 \times 10^{11}$ | $8.6 \times 10^{11}$ | 100 | 98 | 100 | Comparison |
| 30 | P-1 | 0.7 | L-2 | 0.4 | D* | $3.0 \times 10^3$ | $1.8 \times 10^{11}$ | $8 \times 10^{11}$ | $2.6 \times 10^{11}$ | $8.2 \times 10^{11}$ | $6.0 \times 10^{11}$ | $8.5 \times 10^{11}$ | 100 | 89 | 110 | Comparison |
| 31 | P-1 | 0.7 | L-2 | 0.4 | E* | $3.0 \times 10^3$ | $1.8 \times 10^{11}$ | $8 \times 10^{11}$ | $2.6 \times 10^{11}$ | $8.2 \times 10^{11}$ | $6.0 \times 10^{11}$ | $8.5 \times 10^{11}$ | 101 | 85 | 115 | Comparison |

Notes: Comparative curing agent

D 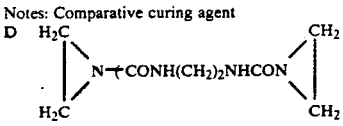

E 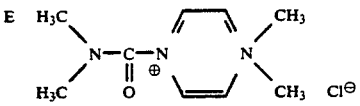

EXAMPLE 3

In 1 l of water were dissolved 10 g of KBr, 0.5 wt % of thioether: $HO(CH_2)_2S(CH_2)_2S(CH_2)_2OH$, 30 g of gelatin, and the solution was maintained at 70° C. Then, 30 ml of 0.88 mol/l $AgNO_3$ aqueous solution and 30 ml of 0.88 mol/l aqueous solution of KI and KBr (KI/KBr mol ratio was 3.5:96.5) were added thereto b the double-jet method. On completion of the addition, the temperature was lowered to 40° C. and the pH was adjusted to 6.0.

After desalinating in the same manner as in Example 1, chemical sensitizing was carried out to prepare an emulsion.

Samples according to the invention were prepared with this emulsion. Coated layer structures and all the conditions of the additives were the same as in Example 1. The results are shown in Table 3.

TABLE 3

| Sample No. | Conductive polymer Example Comp. | Conductive polymer g/m² | Hydrophobic polymer Example Comp. | Hydrophobic polymer g/m² | Hardening agent Example Comp. | Hardening agent mol/dm² | Dry layer adhesion (%) | Layer adhesion in processing (%) | Remarks |
|---|---|---|---|---|---|---|---|---|---|
| 32 | P-2 | 0.6 | L-3 | 0.4 | H-3 | $3.0 \times 10^{-3}$ | 80 | 85 | Invention |
| 33 | P-2 | 0.6 | L-3 | 0.4 | H-3 | $3.0 \times 10^{-3}$ | 85 | 90 | Invention |
| 34 | P-2 | 0.6 | L-8 | 0.4 | H-3 | $3.0 \times 10^{-3}$ | 95 | 95 | Invention |
| 35 | P-6 | 0.6 | L-8 | 0.4 | H-3 | $3.0 \times 10^{-3}$ | 95 | 95 | Invention |
| 36 | P-6 | 0.6 | L-8 | 0.4 | H-10 | $3.0 \times 10^{-3}$ | 95 | 95 | Invention |
| 37 | P-6 | 0.6 | L-8 | 0.4 | H-10 | $3.0 \times 10^{-3}$ | 95 | 90 | Invention |
| 38 | P-6 | 0.6 | L-6 | 0.4 | H-10 | $3.0 \times 10^{-3}$ | 95 | 90 | Invention |
| 39 | P-18 | 0.6 | L-6 | 0.4 | H-6 | $3.0 \times 10^{-3}$ | 90 | 90 | Invention |
| 40 | P-18 | 0.6 | L-6 | 0.4 | H-6 | $3.0 \times 10^{-3}$ | 90 | 95 | Invention |
| 41 | — | — | — | — | — | — | 90 | 85 | Comparison |
| 42 | P-2 | 0.6 | L-3 | 0.4 | D* | $3.0 \times 10^{-3}$ | 70 | 50 | Comparison |
| 43 | P-2 | 0.6 | L-3 | 0.4 | E* | $3.0 \times 10^{-3}$ | 65 | 55 | Comparison |

Notes:
D and E are the same as in Example 2

As apparent from Tables 2 and 3, samples of the invention, which were exposed to severe environment and then evaluated for surface specific resistance after and before development, maintained good properties.

In photographic properties, they also exhibited a good stability without causing a substantial reduction in sensitivity even after the preservation in severe conditions.

What is claimed is:

1. A silver halide photographic light-sensitive material comprising a support, a silver halide emulsion layer and an antistatic layer comprising a water-soluble conductive polymer, a hydrophobic polymer particle and a silane coupling agent represented by the following Formula I:

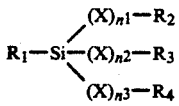

(I)

wherein X is an oxygen atom or a —OCO— group; $R_1$, $R_2$, $R_3$ and $R_4$ are each an alkyl group or an aryl group which may be the same or different and are allowed to be substitued, and at least one of those groups represented by $R_1$, $R_2$, $R_3$ and $R_4$ is a group containing a double bond, a halogen atom, an epoxy group, an acid anhydride residue, an alkoxy group, an alkoxycarbonyl group, an amino group, an acryloyl group, a methacryloyl group, an acrylamido group, a methacrylamido group or a haloacylamino group; $n^1$, $n^2$ and $n^3$ are each 0 or 1, which may be the same or different, provided that the total of $n^1$, $n^2$ and $n^3$ is 1 or more.

2. A material of claim 1, wherein said water-soluble conductive polymer comprising a structual unit having an aromatic ring or a heterocyclic ring each of which has a sulfonic group or an salt thereof linked directly or via a divalent conjunction group and has a molecular weight of 100 to 10,000,000.

3. A material of claim 2, wherein said water-soluble conductive poplymer has a molecular weight of 10,000 to 500,000.

4. A material of claim 1, wherein said water-soluble conductive polymer has a a surface resistance of not more than $10^{10}\Omega$/cm.

5. A material of claim 1, wherein said water-soluble conductive polymer is contained said antistatic layer in an amount of from 0.001 to 10 g/m$^2$.

6. A material of claim 5, wherein said water-soluble conductive polymer is contained said antistatic layer in an amount of from 0.05 to 5 g/m$^2$.

7. A material of claim 1, wherein said antistatic layer has a swelling degree of from 0.2 to 100%.

8. A material of claim 7, said swelling degree is 2 to 50%.

9. A material of claim 1, wherein said antistatic layer has a thickness of from 0.1 μm to 100 μm.

10. A material of claim 9, wherein said antistatic layer has a thickness is 0.1 μm to 10 μm.

11. A material of claim 1, wherein said hydrophobic polymer particle comprises a polymer containing a structual unit selected from a styrene derivative, an alkyl acrylate and an alkyl methacrylate in a ratio of not less than 30 mol %.

12. A material of claim 11, wherein said hydrophobic polymer particle comprises a polymer containing a structual unit selected from a styrene derivative, an alkyl acrylate and an alkyl methacrylate in a ratio of not less than 50 mol %.

13. A material of claim 1, wherein said hydrophobic polymer particle comprises a polymer having a molecular weight not less than 3,000.

14. A material of claim 1, wherein said antistatic layer coantains said silane coupling agent in an amount of from $70\times10^{-4}$ mol/dm$^2$ to $3.0\times10^{-3}$ mol/dm$^2$.

* * * * *